US005542996A

United States Patent [19]

Nagataki et al.

[11] Patent Number: 5,542,996

[45] Date of Patent: Aug. 6, 1996

[54] METHOD FOR MANUFACTURING AN ULTRA-HIGH STRENGTH COLD-ROLLED STEEL SHEET WITH DESIRABLE DELAYED FRACTURE RESISTANCE

[75] Inventors: Yasunobu Nagataki; Seishi Tsuyama; Yoshihiro Hosoya; Tomoyoshi Okita; Shuzi Kanetoh; Yasuyuki Takada, all of Tokyo, Japan

[73] Assignee: NKK Corporation, Tokyo, Japan

[21] Appl. No.: 199,254

[22] PCT Filed: Jan. 13, 1994

[86] PCT No.: PCT/JP94/00038

§ 371 Date: Mar. 4, 1994

§ 102(e) Date: Mar. 4, 1994

[87] PCT Pub. No.: WO94/16115

PCT Pub. Date: Jul. 21, 1994

[30] Foreign Application Priority Data

Jan. 14, 1993 [JP] Japan ..... 5-020781

[51] Int. Cl.[6] ..... C22C 38/06; C22C 38/58; C21D 9/46

[52] U.S. Cl. ..... 148/652; 148/654; 148/506

[58] Field of Search ..... 148/652, 654, 148/320, 328, 332, 336, 505, 506

[56] References Cited

U.S. PATENT DOCUMENTS

| | | | |
|---|---|---|---|
| 3,573,898 | 4/1971 | Murai et al. | 420/90 |
| 3,738,874 | 6/1973 | Allten et al. | 148/653 |
| 4,472,208 | 9/1984 | Kunishige | 148/654 |

FOREIGN PATENT DOCUMENTS

| | | |
|---|---|---|
| 61-3843 | 1/1986 | Japan . |
| 61-217529 | 9/1986 | Japan . |
| 62-86149 | 4/1987 | Japan . |
| 2-236223 | 9/1990 | Japan . |
| 2254134 | 10/1990 | Japan . |

*Primary Examiner*—Sikyin Ip

*Attorney, Agent, or Firm*—Frishauf, Holtz, Goodman, Langer & Chick, P.C.

[57] ABSTRACT

A method for manufacturing an ultra-high-strength cold-rolled steel sheet having desirable delayed fracture resistance, which comprises: preparing a material consisting essentially of 0.1 to 0.25 wt. % carbon, up to 1 wt. % silicon, 1 to 2.5 wt. % manganese, up to 0.020 wt. % phosphorus, up to 0.005 wt. % sulfur, 0.01 to 0.05 wt. % soluble aluminum, 0.0010 to 0.0050 wt. % nitrogen, optionally at least one of Nb, Ti or V, optionally at least one of Cu, Ni, B, Cr or Mo, the balance being iron and incidental impurities; subjecting the material to a hot rolling, a pickling and a cold rolling to prepare a cold-rolled steel sheet; and subjecting the cold-rolled steel sheet to a continuous heat treatment which comprises: subjecting the cold-rolled steel sheet to a soaking treatment at a temperature of $Ac_3$ to 900° C. for 30 seconds to 15 minutes, quenching the cold-rolled steel sheet at a quenching rate of at least 400° C./second from a temperature of at least a lower limit temperature ($T_Q$) for starting quenching as expressed by the following formula to a temperature of up to 100° C.: $T_Q$ (°C.)=600+800×C+(20×Si+12×Mo+13×Cr)−(30×Mn+8×Cu+7×Ni+5000×B), wherein C, Si, Mo, Cr, Mn, Cu, Ni and B are respectively weight percents for carbon, silicon, molybdenum, chromium, manganese, copper, nitrogen and boron, and tempering the cold-rolled steel sheet at a temperature of 100° C. to 300° C. for 1 to 15 minutes.

4 Claims, 6 Drawing Sheets

METHOD FOR MANUFACTURING AN ULTRA-HIGH STRENGTH COLD-ROLLED STEEL SHEET WITH DESIRABLE DELAYED FRACTURE RESISTANCE

FIELD OF THE INVENTION

The present invention relates to an ultra-high-strength cold-rolled steel sheet excellent in delayed fracture resistance and a method for manufacturing same.

BACKGROUND OF THE INVENTION

For the purpose of reducing the weight of an automobile or ensuring the safety of passengers, cold-rolled steel sheets having such a high tensile strength as to permit achievement of a higher strength and reduction of the weight of various structural members, are widely used as materials for protective components of an automobile such as a bumper reinforcement and a door guard bar. As a cold-rolled steel sheet having such a high tensile strength, ultra-high-strength cold-rolled steel sheets having a tensile strength of over 100 kgf/mm$^2$ are proposed as follows:

(1) an ultra-high-strength cold-rolled steel sheet, disclosed in Japanese Patent Provisional Publication No. 61-3,843 published on Jan. 9, 1986, which consists essentially of:

carbon (C): from 0.02 to 0.30 wt. %,
silicon (Si): from 0.01 to 2.5 wt. %,
manganese (Mn): from 0.5 to 2.5 wt. %,
and
the balance being iron (Fe) and incidental impurities
(hereinafter referred to as the "prior art 1").

(2) an ultra-high-strength cold-rolled steel sheet, disclosed in Japanese Patent Provisional Publication No. 61-217,529 published on Sep. 27, 1986, which consists essentially of:

carbon (C): from 0.12 to 0.70 wt. %,
silicon (Si): from 0.4 to 1.0 wt. %,
manganese (Mn): from 0.2 to 2.5 wt. %,
soluble aluminum (Sol.Al): from 0.01 to 0.07 wt. %,
nitrogen (total N): up to 0.02 wt. %,
and
the balance being iron (Fe) and incidental impurities
(hereinafter referred to as the "prior art 2").

However, the prior arts 1 and 2 described above have the following problems:

It is true that the cold-rolled steel sheets of the prior arts 1 and 2 are excellent in workability and have a high tensile strength of over 100 kgf/mm$^2$. An ultra-high-strength cold-rolled steel sheet having a tensile strength of over 100 kgf/mm$^2$ is usually formed through the bending. In the cold-rolled steel sheets of the prior arts 1 and 2, however, when the tensile strength of the steel sheet becomes higher over 100 kgf/mm$^2$, a fracture phenomenon (hereinafter referred to as the "delayed fracture") is suddenly caused by hydrogen penetrating into the interior of the steel sheet under the effect of a corrosion reaction taking place along with the lapse of time at a portion formed by the above-mentioned bending of the cold-rolled steel sheet. Therefore, even with a high tensile strength, a cold-rolled steel sheet susceptible to the delayed fracture, has a fatal defect as a material for protective components of an automobile, for example.

Under such circumstances, there is a strong demand for the development of an ultra-high-strength cold-rolled steel sheet excellent in the property inhibiting the occurrence of delayed fracture (hereinafter referred to as "delayed fracture resistance") and having a high tensile strength of over 100 kgf/mm$^2$ and a method for manufacturing same, but such an ultra-high-strength cold-rolled steel sheet and a method for manufacturing same have not as yet been proposed.

An object of the present invention is therefore to provide an ultra-high-strength cold-rolled steel sheet excellent in delayed fracture resistance and having a high tensile strength of over 100 kgf/mm$^2$ and a method for manufacturing same.

DISCLOSURE OF THE INVENTION

In accordance with one of the features of the present invention, there is provided an ultra-high-strength cold-rolled steel sheet excellent in delayed fracture resistance, which consists essentially of:

carbon (C): from 0.1 to 0.25 wt. %,
silicon (Si): up to 1 wt. %,
manganese (Mn): from 1 to 2.5 wt. %,
phosphorus (P): up to 0.020 wt. %,
sulfur (S): up to 0.005 wt. %,
soluble aluminum (Sol.Al): from 0.01 to 0.05 wt. %,
nitrogen (N): from 0.0010 to 0.0050 wt. %,
and
the balance being iron (Fe) and incidental impurities; and said cold-rolled steel sheet satisfying the following formulae (1) and (2):

$$TS \geqq 320 \times (\mathrm{Ceq})^2 - 155 \times \mathrm{Ceq} + 102 \quad (1)$$

in said formula (1):
Ceq=C+(Si/24)+(Mn/6);
and $$P_{DF} \geqq 0 \quad (2)$$

in said formula (2):

$$P_{DF} = \ln TS + \exp[Rr/100] + 2.95,$$

where, in said formulae (1) and (2):
$P_{DF}$: delayed fracture resistance index,
TS: tensile strength (kgf/mm$^2$), and
Rr: residual strength ratio (%) of a steel sheet as expressed by (bending/stretching tensile strength)÷(tensile strength) ×100, when the steel sheet has been subjected to a 90° V.-bending with a radius of 5 mm in a direction at right angles to the rolling direction.

The above-mentioned ultra-high-strength cold-rolled steel sheet may further additionally contain at least one element selected from the group consisting of:

niobium (Nb): from 0.005 to 0.05 wt. %,
titanium (Ti): from 0.005 to 0.05 wt. %,
and
vanadium (V): from 0.01 to 0.1 wt. %.

The above-mentioned ultra-high-strength cold-rolled steel sheets may further additionally contain at least one element selected from the group consisting of:

copper (Cu): From 0.1 to 1.0 wt. %,
nickel (Ni): From 0.1 to 1.0 wt. %,
boron (B): from 0.0005 to 0.0030 wt. %,
chromium (Cr): from 0.1 to 1.0 wt. %,
and
molybdenum (Mo): from 0.1 to 0.5 wt. %.

In accordance with another feature of the present invention, there is provided a method for manufacturing an ultra-high-strength cold-rolled steel sheet excellent in delayed fracture resistance, which comprises the steps of:

preparing a material having the chemical compositions as described above; then subjecting said material to a hot rolling, a pickling and a cold rolling to prepare a cold-rolled steel sheet; and then subjecting said cold-rolled steel sheet thus prepared to a continuous heat treatment which comprises the steps of: subjecting said cold-rolled steel sheet to a soaking treatment at a temperature within a range of from $Ac_3$ to 900° C. for a period of time within a range of from 30 seconds to 15 minutes, then quenching said cold-rolled steel sheet at a quenching rate of at least 400° C./second from a temperature of at least a lower limit temperature ($T_Q$) for starting quenching as expressed by the following formula to a temperature of up to 100° C.:

$$T_Q\ (°C.) = 600 + 800 \times C + (20 \times Si + 12 \times Mo + 13 \times Cr) - (30 \times Mn + 8 \times Cu + 7 \times Ni + 5000 \times B),$$

and then, tempering said cold-rolled steel sheet at a temperature within a range of from 100° to 300° for a period of time within a range of from 1 to 15 minutes.

DESCRIPTION OF PREFERRED EMBODIMENTS

Figure 1:
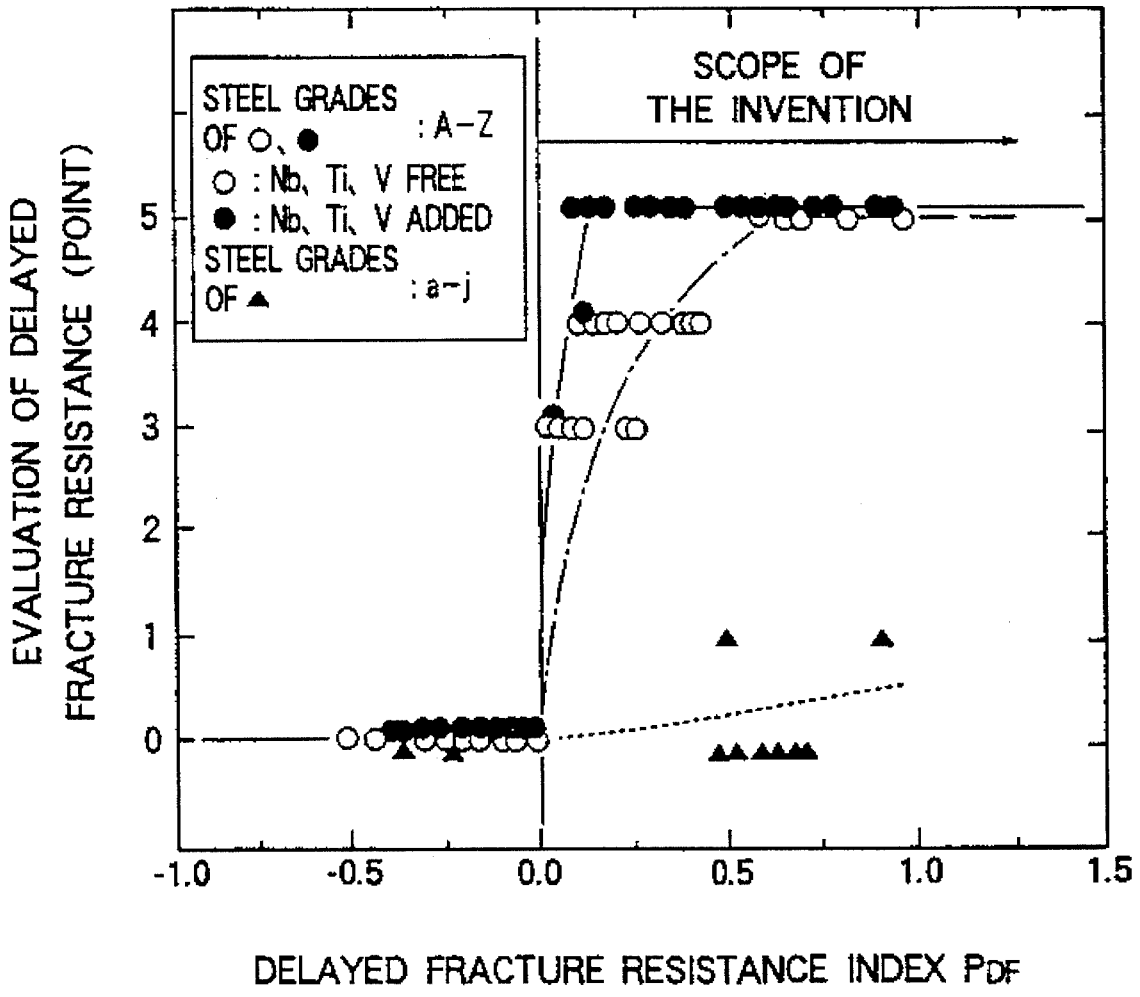
FIG. 1 is a graph illustrating the relationship between an evaluation of delayed fracture resistance and a delayed fracture resistance index ($P_{DF}$) in an ultra-high-strength cold-rolled steel sheet.

From the above-mentioned point of view, extensive studies were carried out to develop an ultra-high-strength cold-rolled steel sheet excellent in delayed fracture resistance and having a high tensile strength of over 100 kgf/mm$^2$ and a method for manufacturing same.

As a result, the following findings were obtained.

For an ultra-high-strength cold-rolled steel sheet having a high tensile strength of over 100 kgf/mm$^2$ susceptible to the delayed fracture after the working, various factors having effects on delayed fracture resistance and the influence thereof were investigated. The investigation revealed that delayed fracture resistance of an ultra-high-strength cold-rolled steel sheet after the working was determined by tensile strength of the cold-rolled steel sheet and the degree of deterioration of the material of the cold-rolled steel sheet caused by the working.

More specifically:

(1) According as tensile strength of a cold-rolled steel sheet becomes larger, delayed fracture resistance of the cold-rolled steel sheet is deteriorated.

(2) According as the degree of deterioration of the material of a cold-rolled steel sheet caused by the working becomes larger, delayed fracture resistance of the cold-rolled steel sheet is deteriorated; and (3) According as the uniformity of the structure of a cold-rolled steel sheet decreases, the degree of deterioration of the material of the cold-rolled steel sheet caused by the working becomes larger.

It is therefore possible to obtain an ultra-high-strength cold-rolled steel sheet excellent in delayed fracture resistance even after the working and having a high tensile strength of over 100 kgf/mm$^2$, by increasing the uniformity of the structure of the steel sheet and specifying the degree of deterioration of the material of the steel sheet, which corresponds to tensile strength of the steel sheet.

The present invention was made on the basis of the above-mentioned findings. The ultra-high-strength cold-rolled steel sheet of the present invention excellent in delayed fracture resistance and having a high tensile strength of over 100 kgf/mm$^2$ and the method for manufacturing same, are described below in detail.

The reasons of limiting the chemical composition of the cold-rolled steel sheet of the present invention within the above-mentioned ranges are described below.

(1) Carbon (C):

Carbon is an element having a function of increasing strength of a low-temperature transformation phase (for example, a martensitic structure or a bainitic structure). A carbon content of under 0.1 wt. % cannot however give a desired effect as described above. A carbon content of over 0.25 wt. % results on the other hand in a seriously decreased shock resistance to cause a deteriorated delayed fracture resistance of the steel sheet. The carbon content should therefore be limited within a range of from 0.1 to 0.25 wt. %.

(2) Silicon (Si):

Silicon is an element having a function of increasing ductility and temper-softening resistance of a steel sheet. A silicon content of over 1 wt. % causes however a considerable grain boundary oxidation in the surface portion of the steel sheet so that, upon the application of a stress to the steel sheet, the stress concentrates in the surface portion of the steel sheet, in which the grain boundary oxidation took place, thus resulting in the deterioration of delayed fracture resistance of the steel sheet. The silicon content should therefore be limited to up to 1 wt. %.

(3) Manganese (Mn):

Manganese is a low-cost element having a function of increasing hardenability of steel and giving a low-temperature transformation phase to steel. A manganese content of under 1 wt. % cannot however give a desired effect as described above. With a manganese content of over 2.5 wt. %, on the other hand, a banded structure caused by the segregation of manganese during the casting grows considerably in steel, deteriorating the uniformity of the structure of steel, and thus causes the deterioration of delayed fracture resistance of the steel sheet. The manganese content should therefore be limited within a range of from 1 to 2.5 wt. %.

(4) Phosphorus (P):

With a phosphorus content of over 0.020 wt. %, phosphorus segregates along grain boundaries of steel to cause the deterioration of delayed fracture resistance of the steel sheet. The phosphorus content should therefore be limited to up to 0.020 wt. %.

(5) Sulfur (S):

With a sulfur content of over 0.005 wt. %, a large amount of non-metallic inclusions (MnS) extending in the rolling direction are produced, and this causes the deterioration of delayed fracture resistance of the steel sheet. The sulfur content should therefore be limited to up to 0.005 wt. %.

(6) Soluble aluminum (Sol.Al):

Soluble aluminum is contained in steel as a residue of aluminum (Al) used as a deoxidizer. However, with a soluble aluminum content of under 0.01 wt. %, silicate inclusions remain in steel, thus causing the deterioration of delayed fracture resistance of the steel sheet. A soluble aluminum content of over 0.05 wt. % increases, on the other hand, surface flaws of the steel sheet to easily cause a delayed fracture of the steel sheet. The soluble aluminum content should therefore be limited within a range of from 0.01 to 0.05 wt. %.

(7) Nitrogen (N):

With a nitrogen content of under 0.0010 wt. %, there decrease nitrides in steel, leading to a coarser structure of steel, and hence to the deterioration of delayed fracture resistance of the steel sheet with a nitrogen content of over 0.0050 wt. %, on the other hand, nitrides in steel become coatset, thus resulting in the deterioration of delayed fracture resistance of the steel sheet. The nitrogen content should therefore be limited within a range of from 0.0010 to 0.0050 wt. %.

(8) The ultra-high-strength cold-rolled steel sheet of the present invention may further additionally contain, in addition to the above-mentioned chemical composition, at least one element selected from the group consisting of: from 0.005 to 0.05 wt. % niobium (Nb), from 0.005 to 0.05 wt. % titanium (Ti), and from 0.01 to 0.1 wt. % vanadium (V).

Niobium, titanium and vanadium have a function of forming carbon nitrides to achieve a finer structure of steel. For any of these elements, however, a content of under the respective lower limits cannot give a desired effect as described above with a content of over the respective upper limits, on the other hand, the above-mentioned desired effect is saturated, and at the same time, carbon nitrides becoming coarser cause the deterioration of delayed fracture resistance of the steel sheet. The respective contents of niobium, titanium and vanadium should therefore be limited within the above-mentioned ranges.

(9) The ultra-high-strength cold-rolled steel sheet of the present invention may further additionally contain, in addition to the above-mentioned chemical compositions, at least one element selected from the group consisting of: from 0.1 to 1.0 wt. % copper (Cu), from 0.1 to 1.0 wt. % nickel (Ni), from 0.0005 to 0.0030 wt. % boron (B), from 0.1 to 1.0 wt. % chromium (Cr) and from 0.1 to 0.5 wt. % molybdenum (Mo).

Copper, nickel, boron, chromium and molybdenum have, just as manganese, a function of increasing hardenability of steel. For any of these elements, with a content of under the respective lower limits, however, the desired effect as described above is not available. With a content of over the respective upper limits, on the other hand, the above-mentioned desired effect is saturated. The respective contents of copper, nickel, boron, chromium and molybdenum should therefore be limited within the above-mentioned ranges.

Now, the reason of specifying tensile strength (TS) of a cold-rolled steel sheet as expressed by the following formula (1) in terms of Ceq (=C+(Si/24)+(Mn/6)) is described below:

$$TS \geqq 320 \times (Ceq)^2 - 155 \times Ceq + 102 \quad (1)$$

A high manganese content in steel promotes, as described above, formation of the banded structure in steel caused by the segregation of manganese during the casting, and thus causes the deterioration of delayed fracture resistance of the steel sheet. Formation of such a banded structure caused by the segregation of manganese is characterized in that: (1) formation of the banded structure is accelerated under the effect of coexistence of manganese with carbon (C) and silicon (Si), and (2) formation of the banded structure becomes more remarkable according as the structure of steel becomes composite (i.e., ferritic phase+low-temperature transformation phase). According as the structure of steel becomes more composite, furthermore, tensile strength of the cold-rolled steel sheet decreases.

It is therefore necessary to inhibit formation of the banded structure in steel caused by the segregation of manganese, which is accelerated under the effect of coexistence of manganese with carbon and silicon, and to prevent the structure of steel from becoming composite. More specifically, the structure of steel is prevented from becoming composite by means of Ceq (=C+(Si/24)+(Mn/6)) as determined by the contents of carbon, silicon and manganese.

Since tensile strength of the cold-rolled steel sheet decreases, as described above, along with the structure of steel becoming more composite, it is necessary "to control the lower limit value of tensile strength of the steel sheet by means of the above-mentioned formula (1) as expressed by Ceq, in order to ensure uniformity of the structure of steel.

Now, the delayed fracture resistance index ($P_{DF}$) is described in the following paragraphs.

In order to obtain a cold-rolled steel sheet excellent in delayed fracture resistance even after the working, as described above, it is important to specify the degree of deterioration of the material of the steel sheet, which corresponds to tensile strength of the steel sheet. Experimental data derived from the research reveals that delayed fracture resistance of a cold-rolled steel sheet is improved when a delayed fracture resistance index ($P_{DF}$) of the steel sheet as expressed by the following formula (2) takes a value of at least zero:

$$P_{DF} = -\ln TS + \exp[Rr/100] + 2.95 \quad (2)$$

where,

TS: tensile strength (kgf/mm$^2$),

Rr: residual strength ratio (%) of a steel sheet as expressed by (bending/stretching tensile strength)+(tensile strength) ×100, when the steel sheet has been subjected to a 90° V-bending with a radius of 5 mm in a direction at right angles to the rolling direction.

The first term of-the above-mentioned formula (2) (i.e., "-lnTS") represents the effect of tensile strength (TS) of the cold-rolled steel sheet on delayed fracture resistance of the steel sheet. A higher tensile strength (TS) of the cold-rolled steel sheet leads to a smaller $P_{DF}$ thereof.

The second term of the above-mentioned formula (2) (i.e., "exp[Rr/100]") represents the effect of the degree of deterioration of the material of the cold-rolled steel sheet caused by the working on delayed fracture resistance of the steel sheet. Deterioration of the material of the cold-rolled steel sheet caused by the working reduces the $P_{DF}$ of the steel sheet. The degree of deterioration of the material of the cold-rolled steel sheet caused by the working represents the degree of deterioration of the material of the steel sheet caused by the bending mainly used for forming an ultra-high-strength cold-rolled steel sheet. In the present invention, the degree of deterioration of the material of the steel sheet is represented by, as an index, a residual strength ratio ($R_r$) of a steel sheet which has been subjected to a 90° V-bending with a radius of 5 mm in a direction at right angles to the rolling direction. The direction at right angles to the rolling direction is selected because the material quality of an ultra-high-strength is poorer in the direction at right angles to the rolling direction than in a direction in parallel with the rolling direction, and evaluation is stricter in this direction. A 90° V-bending is applied with a radius of 5 mm because this manner of working is a bending method most commonly used for an ultra-high-strength cold-rolled steel sheet.

Figure 5:
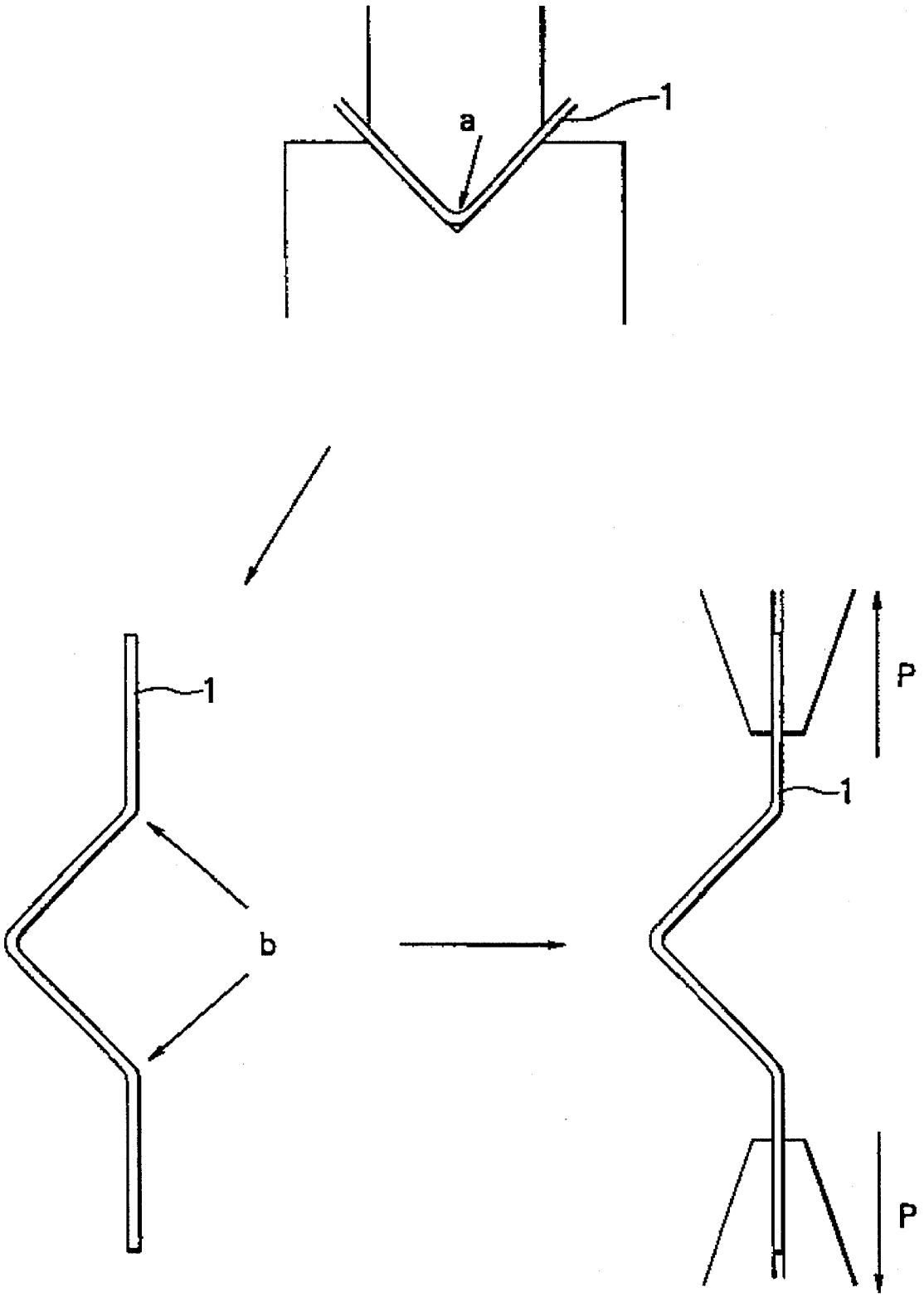
FIG. 5 is a schematic descriptive view illustrating the steps for measuring a residual strength ratio ($R_r$) in an ultra-high-strength cold-rolled steel sheet.

Steps for measuring the residual strength ratio ($R_r$) of a cold-rolled steel sheet is illustrated in FIG. 5. As shown in FIG. 5, the above-mentioned measuring steps comprise: subjecting a portion "a" of a test piece 1 cut out from a cold-rolled steel sheet to a 90° V-bending with a radius of 5 mm in a direction at right angles to the rolling direction; then subjecting both sides "b" of the portion "a" of the test piece 1 to a bending with a radius of 6 mm to form a grip on each of the both end portions of the test piece 1; and then grasping the grips by means of a tensile testor to draw the test piece 1 in directions as indicated by "P" so as to determine a fracture stress at the moment of fracture of the test piece 1 at the portion "a". The thus determined fracture stress is referred to as the bending/stretching tensile strength, and the value calculated in accordance with a formula "(bending/stretching tensile strength)+(tensile strength before bending) ×100", is adopted as the residual strength ratio ($R_r$) (%) of the cold-rolled steel sheet.

The third term of the above-mentioned formula (2) (i.e., "+2.95") represents the correction for making the critical value of $P_{DF}$ zero.

Now, the reasons of limiting the manufacturing method of the present invention within the above-mentioned ranges are described below.

As described above in the findings, delayed fracture resistance of a cold-rolled steel sheet can be improved by increasing uniformity of the structure of the steel sheet and specifying the degree of deterioration of the material of the steel sheet, which corresponds to tensile strength of the steel sheet. In the manufacturing method of the present invention, therefore, it is important to make up for the deterioration of delayed fracture resistance of the cold-rolled steel sheet caused according as tensile strength of the steel sheet becomes larger, by uniforming the structure of the steel sheet to inhibit deterioration of the material of the steel sheet caused by the bending.

For this purpose, a material having a specific chemical composition is first hot-rolled and cold-rolled by the conventional methods to prepare a cold-rolled steel sheet, and then, the cold-rolled steel sheet thus prepared is subjected, in a continuous annealing, to a soaking treatment at a temperature within a range of from $Ac_3$ to 900° C. for a period of time within a range of from 30 seconds to 15 minutes when a soaking treatment is applied at a temperature of under $Ac_3$, an as-rolled structure remains in the cold-rolled steel sheet to deteriorate uniformity of the structure of the steel sheet. Application of the soaking treatment to the cold-rolled steel sheet at a temperature of over 900° C., on the other hand, gives rise to various operational problems, and, furthermore, the structure of steel becomes coarser to cause the deterioration of delayed fracture resistance of the steel sheet. Application of the soaking treatment to the cold-rolled steel sheet for a period of time of under 30 seconds makes it impossible to stably obtain an austenitic phase. When the soaking treatment is applied to the cold-rolled steel sheet for a period of time of over 15 minutes, on the other hand, the effect reaches saturation thereof. The conditions for the soaking treatment should therefore be limited within the ranges described above.

Then, the cold-rolled steel sheet, which has been subjected to the above-mentioned soaking treatment, is then slowly cooled to control the strength level thereof. The slow cooling rate should appropriately be within a range of from 1° to 30° C./second to minimize variations in the material quality in the width direction and the longitudinal direction of the steel sheet. After the completion of the above-mentioned slow cooling, the cold-rolled steel sheet is quenched. When the quenching starting temperature is low, the volume ratio of the precipitated ferritic phase increases, thus causing the deterioration of uniformity of the structure of the steel sheet. The quenching starting temperature should therefore be limited to at least a lower limit temperature ($T_Q$) for starting quenching as expressed by the following formula:

$$T_Q\,(°C.) = 600 + 800 \times C + (20 \times Si + 12 \times Mo + 13 \times Cr) - (30 \times Mn + 8 \times Cu + 7 \times Ni + 5000 \times B)$$

In the above-mentioned formula, the elements such as C and Si are represented in wt. % a as unit. In this formula, furthermore, the elements Si, Mo and Cr, which have a function of increasing the $Ar_3$ transformation point, act to increase the $T_Q$ because they promote precipitation of the ferritic phase. The elements Mn, Cu, Ni and B, which have a function of decreasing the $Ar_3$ transformation point, act to reduce the $T_Q$ because they inhibit precipitation of the ferritic phase. The element C, which has a function of reducing the $Ar_3$ transformation point, just as Mn, Cu, Ni and B, has an effect on the $T_Q$, unlike Mn, Cu, Ni and B. More specifically, even in a structure of steel having a ferritic phase of the same volume ratio, a higher C content leads to an increased difference in hardness between the low-temperature transformation phase and the ferritic phase, so that, upon the working, strain concentrates on the interface, resulting in a considerable deterioration of the material of the steel sheet. With a higher C content, therefore, it is necessary to inhibit precipitation of the ferritic phase.

Subsequently, the cold-rolled steel sheet is quenched at a quenching rate of at least 400° C./second from a temperature of at least the above-mentioned lower limit temperature ($T_Q$) for starting quenching to a temperature of up to 100° C., to obtain a low-temperature transformation phase. When quenching is conducted at a cooling rate of under 400° C./second, or to a temperature of over 100° C., it is necessary to increase the contents of elements required for obtaining a desired high strength. This results in a higher manufacturing cost, and in addition, the mixed existence of the martensitic structure and the bainitic structure causes the deterioration of uniformity of the structure of the steel sheet. The quenching rate and the quenching stoppage temperature should therefore be limited within the above-mentioned ranges.

Then, the cold-rolled steel sheet is subjected to a tempering treatment, since an as-quenched martensitic phase of the steel sheet is brittle and thermally unstable. The tempering treatment is applied at a temperature within a range of from 100° to 300° C. for a period of time within a range of from 1 to 15 minutes. A tempering treatment at a temperature of under 100° C. results in an insufficient tempering of the martensitic phase. A tempering treatment at a temperature of over 300° C. causes, on the other hand, the precipitation of carbides on the crystal grain boudaries, and hence a serious deterioration of the material of the steel sheet caused by the working. A tempering treatment for a period of time of under one minute results in an insufficient tempering of the martensitic phase when a tempering treatment is applied for a period of time of over 15 minutes, the tempering effect is saturated.

Now, the ultra-high-strength cold-rolled steel sheet of the present invention excellent in delayed fracture resistance and the method for manufacturing same, are described further in detail by means of examples while comparing with examples for comparison.

EXAMPLES

Steels "A" to "Z" having chemical compositions within the scope of the present invention as shown in Table 1, and steels "a" to "j" having chemical compositions outside the scope of the present invention as shown also in Table 1, were tapped from a converter, and then, were continuously cast into respective slabs. The resultant slabs were then hot-rolled under conditions including a heating temperature of 1,200° C., a finishing temperature of 820° C. and a coiling temperature of 600° C., to prepare hot-rolled steel sheets having a thickness of 3 mm. Then, the thus prepared hot-rolled steel sheets were pickled and cold-rolled to prepare cold-rolled steel sheets having a thickness of 1.4 mm. The thus prepared cold-rolled steel sheets were then subjected to a heat treatment in a combination-type continuous annealing line including a water-quenching apparatus and a roll-quenching apparatus under conditions as shown in Tables 2 and 4. The water quenching was applied at a cooling rate of about 1,000° C./second, and the roll quenching was applied at a cooling rate of about 200° C./second.

Thus, there were prepared samples of the cold-rolled steel sheets of the present invention, having chemical compositions within the scope of the present invention and subjected to heat treatments within the scope of the present invention (hereinafter referred to as the "samples of the invention") Nos. 1 to 3, 6 to 9, 11, 13, 15, 17 to 24, 26, 28, 29, 32 to 38, 40, 42, 43, 48, 50, 52 to 54, 56, 57, 59 to 64, 66, 68, 71, 72, 91, 92, 94 and 95, and, samples of the cold-rolled steel sheets having chemical compositions outside the scope of the present invention, and samples of the cold-rolled steel sheets, which, having chemical compositions within the scope of the present invention, were subjected to heat treatments outside the scope of the present invention (hereinafter referred to as the "samples for comparison") Nos. 4, 5, 10, 12, 14, 16, 25, 27, 30, 31, 39, 41, 44 to 47, 49, 51, 55, 58, 65, 67, 69, 70, 73 to 85, 93 and 96 to 98 were prepared.

For each of the above-mentioned samples of the invention and samples for comparison, tensile strength (TS), a residual strength ratio ($R_r$) a delayed fracture resistance index ($P_{DF}$) and delayed fracture resistance were investigated. The results are shown in Tables 3 and 4.

TABLE 1

| Kind of Steel | C | Si | Mn | P | S | sol. Al | N | Nb | Ti | V | Cu | Ni | B | Cr | Mo | Ceq | $Ac_3$ (°C.) |
|---|---|---|---|---|---|---|---|---|---|---|---|---|---|---|---|---|---|
| A | 0.12 | 0.3 | 1.6 | 0.011 | 0.004 | 0.037 | 0.0023 | | | | | | | | | 0.40 | 828 |
| B | 0.20 | 0.6 | 1.2 | 0.017 | 0.001 | 0.038 | 0.0039 | | | | | | | 0.1 | | 0.43 | 836 |
| C | 0.15 | 0.4 | 1.5 | 0.008 | 0.002 | 0.048 | 0.0033 | 0.015 | | | | | | | | 0.42 | 829 |
| D | 0.23 | 0.7 | 2.2 | 0.012 | 0.002 | 0.016 | 0.0028 | | 0.020 | | | | | | | 0.63 | 793 |
| E | 0.21 | 0.9 | 1.8 | 0.012 | 0.005 | 0.030 | 0.0016 | | | | | | | | | 0.55 | 824 |
| F | 0.11 | 0.2 | 1.9 | 0.018 | 0.004 | 0.019 | 0.0048 | | | | | | | | | 0.44 | 815 |
| G | 0.16 | 0.4 | 1.0 | 0.016 | 0.001 | 0.021 | 0.0031 | 0.006 | | | | | | 0.5 | 0.3 | 0.34 | 840 |
| H | 0.24 | 0.2 | 1.2 | 0.007 | 0.005 | 0.031 | 0.0036 | | | | 0.9 | | | | | 0.45 | 783 |
| I | 0.15 | 0.7 | 1.5 | 0.015 | 0.002 | 0.018 | 0.0011 | | | | | | | | | 0.43 | 835 |
| J | 0.19 | 0.4 | 1.8 | 0.017 | 0.001 | 0.023 | 0.0048 | 0.048 | | | | | | | | 0.51 | 806 |
| K | 0.12 | 0.9 | 2.5 | 0.007 | 0.003 | 0.031 | 0.0021 | | 0.031 | 0.02 | | | | | | 0.57 | 822 |
| L | 0.15 | 0.1 | 1.5 | 0.013 | 0.001 | 0.035 | 0.0036 | 0.020 | 0.005 | | | | | 0.1 | | 0.40 | 813 |
| M | 0.15 | 0.4 | 1.0 | 0.017 | 0.004 | 0.029 | 0.0031 | | | | | 0.9 | | | | 0.33 | 829 |
| N | 0.13 | 0.5 | 1.7 | 0.015 | 0.001 | 0.012 | 0.0021 | 0.015 | | | | | 0.008 | | | 0.43 | 823 |
| O | 0.21 | 0.4 | 2.3 | 0.011 | 0.004 | 0.011 | 0.0018 | | | 0.09 | | | | | | 0.61 | 778 |
| P | 0.24 | 0.8 | 1.0 | 0.019 | 0.005 | 0.044 | 0.0029 | | | | | | | | 0.5 | 0.44 | 863 |
| Q | 0.10 | 0.2 | 2.0 | 0.010 | 0.001 | 0.041 | 0.0021 | | | | | | | | | 0.44 | 818 |
| R | 0.23 | 0.9 | 1.2 | 0.015 | 0.002 | 0.030 | 0.0039 | | | | 0.1 | 0.5 | | | | 0.47 | 830 |
| S | 0.10 | 0.2 | 1.1 | 0.019 | 0.004 | 0.027 | 0.0031 | 0.018 | | | | 0.1 | 0.0005 | | | 0.29 | 844 |
| T | 0.11 | 0.4 | 1.5 | 0.011 | 0.005 | 0.031 | 0.0029 | | 0.048 | | | | | | | 0.38 | 836 |
| U | 0.22 | Tr. | 1.1 | 0.007 | 0.002 | 0.018 | 0.0015 | 0.015 | | | | | | 0.9 | | 0.40 | 784 |
| V | 0.15 | Tr. | 1.2 | 0.012 | 0.003 | 0.021 | 0.0028 | | | | | | | | | 0.35 | 812 |
| W | 0.20 | 0.2 | 1.1 | 0.015 | 0.005 | 0.025 | 0.0031 | | | | | | | | | 0.39 | 816 |
| X | 0.17 | 0.5 | 1.6 | 0.011 | 0.002 | 0.023 | 0.0024 | | 0.030 | | | | 0.0028 | | | 0.46 | 818 |
| Y | 0.24 | 0.7 | 2.5 | 0.012 | 0.002 | 0.019 | 0.0030 | 0.031 | | | | | | | | 0.69 | 783 |
| Z | 0.22 | 0.9 | 2.4 | 0.010 | 0.003 | 0.023 | 0.0041 | | | | | | | | | 0.66 | 799 |
| a | 0.20 | 0.4 | 2.5 | 0.012 | 0.001 | 0.031 | *0.0008 | | | | | | | | | 0.63 | 783 |
| b | 0.13 | 0.1 | *2.7 | 0.011 | 0.004 | 0.025 | 0.0043 | | | | | | | | | 0.58 | 778 |
| c | 0.13 | *1.1 | 2.0 | 0.014 | 0.002 | 0.013 | 0.0037 | | | | | | | | | 0.51 | 841 |
| d | 0.15 | 0.7 | 1.6 | *0.022 | 0.004 | 0.047 | 0.0017 | | | | | | | | | 0.45 | 849 |
| e | 0.21 | 0.3 | 1.1 | 0.007 | *0.006 | 0.040 | 0.0027 | | | | | | | | | 0.41 | 818 |
| f | *0.26 | 0.2 | 1.5 | 0.011 | 0.005 | 0.020 | 0.0031 | | | | | | | | | 0.52 | 786 |
| g | 0.11 | 0.5 | 1.8 | 0.018 | 0.001 | *0.052 | 0.0026 | | | | | | | | | 0.43 | 844 |
| h | 0.18 | 0.1 | 2.2 | 0.012 | 0.002 | 0.030 | 0.0021 | *0.060 | | | | | | | | 0.55 | 783 |
| i | 0.18 | 0.3 | 1.7 | 0.015 | 0.001 | 0.033 | 0.0012 | | *0.070 | | | | | | | 0.48 | 810 |
| j | 0.12 | 0.9 | 2.1 | 0.014 | 0.004 | 0.011 | 0.0035 | | | *0.11 | | | | | | 0.51 | 831 |

Mark "*" shows outside the scope of the present invention.
Ceq = C + Si/24 + Mn/6

TABLE 2

| Sample No. | Kind of Steel | Ceq | Soaking temperature (°C.) | Lower limit temperature for quench. start (°C.) | Quench. start temperature (°C.) | Tempering temperature (°C.) | Tempering time (sec.) | Lower limit of tensile strength (kgf/mm$^2$) |
|---|---|---|---|---|---|---|---|---|
| 1 | A | 0.40 | 850 | 654 | 730 | 200 | 600 | 91 |
| 2 | A | 0.40 | 850 | 654 | 720 | 200 | 600 | 91 |
| 3 | A | 0.40 | 890 | 654 | 780 | 150 | 300 | 91 |
| 4 | A | 0.40 | *802 | 654 | 660 | 240 | 180 | 91 |
| 5 | B | 0.43 | 850 | 737 | *720 | 300 | 300 | 95 |
| 6 | B | 0.43 | 820 | 737 | 740 | 270 | 900 | 95 |
| 7 | C | 0.42 | 850 | 683 | 770 | 100 | 100 | 93 |
| 8 | C | 0.42 | *800 | 683 | 750 | 220 | 800 | 93 |
| 9 | C | 0.42 | 850 | 683 | 710 | 220 | 700 | 93 |
| 10 | D | 0.63 | 800 | 732 | *700 | 120 | 520 | 131 |
| 11 | D | 0.63 | 820 | 732 | 780 | 180 | 300 | 131 |
| 12 | D | 0.63 | 820 | 732 | 750 | *350 | 450 | 131 |
| 13 | D | 0.63 | 850 | 732 | 740 | 260 | 120 | 131 |
| 14 | D | 0.63 | 850 | 732 | *680 | 260 | 120 | 131 |
| 15 | E | 0.55 | 840 | 732 | 750 | 260 | 80 | 114 |
| 16 | E | 0.55 | 840 | 732 | *700 | 200 | 600 | 114 |
| 17 | E | 0.55 | 840 | 732 | 740 | 200 | 510 | 114 |
| 18 | F | 0.44 | 850 | 635 | 760 | 200 | 540 | 96 |
| 19 | G | 0.34 | 850 | 716 | 770 | 110 | 700 | 86 |
| 20 | G | 0.34 | 850 | 716 | 720 | 250 | 220 | 86 |
| 21 | H | 0.45 | 820 | 753 | 770 | 100 | 600 | 97 |
| 22 | H | 0.45 | 820 | 753 | *750 | 290 | 600 | 97 |
| 23 | I | 0.43 | 850 | 689 | 760 | 180 | 60 | 95 |
| 24 | I | 0.43 | 850 | 689 | 700 | 240 | 900 | 95 |
| 25 | J | 0.51 | 830 | 706 | *700 | *400 | 800 | 106 |
| 26 | J | 0.51 | 830 | 706 | 750 | 180 | 800 | 106 |
| 27 | J | 0.51 | 830 | 706 | *680 | 200 | 800 | 106 |
| 28 | J | 0.51 | 830 | 706 | 740 | 250 | 800 | 106 |
| 29 | J | 0.51 | 830 | 706 | 745 | 250 | 500 | 106 |
| 30 | J | 0.51 | 830 | 706 | *610 | 250 | 500 | 106 |
| 31 | K | 0.57 | *800 | 639 | 720 | 200 | 500 | 118 |
| 32 | K | 0.57 | 840 | 639 | 750 | 220 | 400 | 118 |
| 33 | K | 0.57 | 840 | 639 | 720 | 130 | 400 | 118 |
| 34 | L | 0.40 | 830 | 678 | 730 | 200 | 900 | 91 |
| 35 | L | 0.40 | 850 | 678 | 710 | 260 | 500 | 91 |
| 36 | L | 0.40 | 850 | 678 | *660 | 200 | 800 | 91 |
| 37 | M | 0.33 | 840 | 692 | 730 | 130 | 700 | 86 |
| 38 | M | 0.33 | 840 | 692 | 710 | 130 | 700 | 86 |
| 39 | M | 0.33 | 840 | 692 | *680 | 130 | 700 | 86 |
| 40 | N | 0.43 | 840 | 659 | 740 | 260 | 100 | 95 |
| 41 | O | 0.61 | 840 | 707 | 750 | *360 | 600 | 127 |
| 42 | O | 0.61 | 840 | 707 | 750 | 270 | 900 | 127 |
| 43 | O | 0.61 | 840 | 707 | 750 | 120 | 900 | 127 |
| 44 | O | 0.61 | 790 | 707 | *620 | 260 | 410 | 127 |
| 45 | P | 0.44 | 880 | 784 | *720 | 200 | 500 | 96 |
| 46 | P | 0.44 | 880 | 784 | *760 | 200 | 500 | 96 |
| 47 | P | 0.44 | 880 | 784 | 800 | *320 | 500 | 96 |
| 48 | Q | 0.44 | 870 | 624 | 770 | 150 | 800 | 96 |
| 49 | R | 0.47 | 840 | 762 | *700 | 180 | 200 | 100 |
| 50 | R | 0.47 | 840 | 762 | 770 | 260 | 300 | 100 |
| 51 | R | 0.47 | 840 | 762 | 780 | *310 | 400 | 100 |
| 52 | R | 0.47 | 870 | 762 | 770 | 290 | 750 | 100 |
| 53 | S | 0.29 | 850 | 648 | 740 | 200 | 100 | 84 |
| 54 | S | 0.29 | 890 | 648 | 770 | 100 | 550 | 84 |
| 55 | S | 0.29 | *820 | 648 | 690 | 200 | 100 | 84 |
| 56 | T | 0.38 | 840 | 651 | 720 | 250 | 500 | 89 |
| 57 | U | 0.40 | 820 | 755 | *710 | 260 | 700 | 91 |
| 58 | U | 0.40 | 840 | 755 | 770 | *400 | 800 | 91 |
| 59 | U | 0.40 | 840 | 755 | 770 | 230 | 150 | 91 |
| 60 | V | 0.35 | 820 | 684 | 770 | 100 | 500 | 87 |
| 61 | V | 0.35 | 850 | 684 | 750 | 220 | 700 | 87 |
| 62 | W | 0.39 | 850 | 731 | 760 | *450 | 500 | 90 |
| 63 | W | 0.39 | 850 | 731 | 760 | 260 | 700 | 90 |
| 64 | X | 0.46 | 830 | 684 | 760 | 180 | 800 | 98 |
| 65 | X | 0.46 | *790 | 684 | 740 | 220 | 300 | 98 |
| 66 | X | 0.46 | 850 | 684 | 710 | 200 | 300 | 98 |
| 67 | X | 0.46 | *800 | 684 | *670 | 200 | 300 | 98 |
| 68 | Y | 0.69 | 860 | 731 | 800 | 230 | 420 | 147 |
| 69 | Y | 0.69 | 860 | 731 | *728 | 230 | 420 | 147 |
| 70 | Y | 0.69 | 820 | 731 | *720 | 270 | 260 | 147 |
| 71 | Z | 0.66 | 840 | 722 | 790 | 240 | 300 | 139 |
| 72 | Z | 0.66 | 840 | 722 | 760 | 200 | 180 | 139 |
| 73 | Z | 0.66 | 840 | 722 | *700 | 200 | 180 | 139 |
| 74 | Z | 0.66 | 870 | 722 | *720 | 180 | 220 | 139 |

TABLE 2-continued

| Sample No. | Kind of Steel | Ceq | Soaking temperature (°C.) | Lower limit temperature for quench. start (°C.) | Quench. start temperature (°C.) | Tempering temperature (°C.) | Tempering time (sec.) | Lower limit of tensile strength (kgf/mm$^2$) |
|---|---|---|---|---|---|---|---|---|
| 75 | a | 0.63 | 830 | 693 | 760 | 120 | 500 | 131 |
| 76 | b | 0.58 | 800 | 625 | 730 | 200 | 900 | 120 |
| 77 | c | 0.51 | 850 | 666 | 750 | 270 | 100 | 106 |
| 78 | d | 0.45 | 850 | 686 | 770 | 100 | 400 | 97 |
| 79 | e | 0.41 | 820 | 741 | 750 | 230 | 800 | 92 |
| 80 | e | 0.41 | 820 | 741 | *700 | 200 | 600 | 92 |
| 81 | f | 0.52 | 830 | 767 | 770 | 250 | 100 | 108 |
| 82 | g | 0.43 | 860 | 644 | 770 | 180 | 500 | 95 |
| 83 | h | 0.55 | 820 | 680 | 740 | 200 | 200 | 114 |
| 84 | i | 0.48 | 840 | 699 | 760 | 110 | 700 | 101 |
| 85 | j | 0.51 | 850 | 651 | 730 | 230 | 100 | 106 |

Ceq = C + Si/24 + Mn/6
Lower limit of tensile strength = $320 \times (Ceq)^2 - 155 \times Ceq + 102$
Mark "*" shows outside the scope of the present invention.

TABLE 3

| Sample No. | Kind of Steel | Tensile strength (kgf/mm$^2$) | Residual strength ratio (%) | $P_{DF}$ | Delayed fracture resistance evaluation (points) | Remarks |
|---|---|---|---|---|---|---|
| 1 | A | 113 | 95 | 0.808 | 5 | Sample of the invention |
| 2 | A | 102 | 72 | 0.379 | 4 | Sample of the invention |
| 3 | A | 129 | 73 | 0.165 | 4 | Sample of the invention |
| 4 | A | *82 | 33 | −0.066 | 0 | Sample for comparison |
| 5 | B | 128 | 60 | −0.080 | 0 | Sample for comparison |
| 6 | B | 140 | 81 | 0.256 | 4 | Sample of the invention |
| 7 | C | 143 | 95 | 0.573 | 5 | Sample of the invention |
| 8 | C | 122 | 63 | 0.024 | 3 | Sample of the invention |
| 9 | C | 103 | 96 | 0.927 | 5 | Sample of the invention |
| 10 | D | 156 | 70 | −0.086 | 0 | Sample for comparison |
| 11 | D | 171 | 93 | 0.343 | 5 | Sample of the invention |
| 12 | D | *125 | 40 | −0.386 | 0 | Sample for comparison |
| 13 | D | 142 | 85 | 0.334 | 5 | Sample of the invention |
| 14 | D | *115 | 42 | −0.273 | 0 | Sample for comparison |
| 15 | E | 169 | 82 | 0.091 | 3 | Sample of the invention |
| 16 | E | 140 | 68 | −0.018 | 0 | Sample for comparison |
| 17 | E | 151 | 79 | 0.136 | 4 | Sample of the invention |
| 18 | F | 112 | 100 | 0.950 | 5 | Sample of the invention |
| 19 | G | 150 | 95 | 0.525 | 5 | Sample of the invention |
| 20 | G | 92 | 90 | 0.888 | 5 | Sample of the invention |
| 21 | H | 178 | 85 | 0.108 | 3 | Sample of the invention |
| 22 | H | 148 | 74 | 0.049 | 3 | Sample of the invention |
| 23 | I | 145 | 96 | 0.585 | 5 | Sample of the invention |
| 24 | I | 109 | 61 | 0.099 | 4 | Sample of the invention |
| 25 | J | 115 | 53 | −0.096 | 0 | Sampel for comparison |
| 26 | J | 163 | 82 | 0.127 | 5 | Sample of the invention |
| 27 | J | 123 | 52 | −0.180 | 0 | Sample for comparison |
| 28 | J | 130 | 82 | 0.353 | 5 | Sample of the invention |
| 29 | J | 142 | 95 | 0.580 | 5 | Sample of the invention |
| 30 | J | *87 | 35 | −0.097 | 0 | Sample for comparison |
| 31 | K | *107 | 30 | −0.373 | 0 | Sample for comparison |
| 32 | K | 121 | 96 | 0.766 | 5 | Sample of the invention |
| 33 | K | 140 | 100 | 0.727 | 5 | Sample of the invention |
| 34 | L | 135 | 91 | 0.529 | 5 | Sample of the invention |
| 35 | L | 125 | 93 | 0.656 | 5 | Sample of the invention |
| 36 | L | 118 | 67 | 0.134 | 5 | Sample of the invention |
| 37 | M | 129 | 75 | 0.207 | 4 | Sample of the invention |
| 38 | M | 116 | 71 | 0.230 | 3 | Sample of the invention |
| 39 | M | 103 | 49 | −0.052 | 0 | Sample for comparison |
| 40 | N | 126 | 82 | 0.384 | 5 | Samaple of the invention |
| 41 | O | 133 | 61 | −0.100 | 0 | Sample for comparison |
| 42 | O | 150 | 78 | 0.121 | 4 | Sample of the invention |
| 43 | O | 166 | 90 | 0.298 | 5 | Sample of the invention |
| 44 | O | *98 | 36 | −0.202 | 0 | Sample for comparison |
| 45 | P | 162 | 53 | −0.439 | 0 | Sampel for comparison |
| 46 | P | 178 | 80 | −0.006 | 0 | Sample for comparison |
| 47 | P | 173 | 67 | −0.249 | 0 | Sample for comparison |
| 48 | Q | 120 | 91 | 0.647 | 5 | Sample of the invention |
| 49 | R | 145 | 42 | −0.505 | 0 | Sample for comparison |
| 50 | R | 170 | 92 | 0.323 | 4 | Sample of the invention |

TABLE 3-continued

| Sample No. | Kind of Steel | Tensile strength (kgf/mm$^2$) | Residual strength ratio (%) | $P_{DF}$ | Delayed fracture resistance evaluation (points) | Remarks |
|---|---|---|---|---|---|---|
| 51 | R | 150 | 56 | −0.310 | 0 | Sample for comparison |
| 52 | R | 105 | 75 | 0.413 | 4 | Sample of the invention |
| 53 | S | 105 | 96 | 0.908 | 5 | Sample of the invention |
| 54 | S | 110 | 75 | 0.367 | 5 | Sample of the invention |
| 55 | S | *83 | 29 | −0.132 | 0 | Sample for comparison |
| 56 | T | 105 | 83 | 0.589 | 5 | Sample of the invention |
| 57 | U | 135 | 69 | 0.038 | 3 | Sample of the invention |
| 58 | U | 136 | 50 | −0.314 | 0 | Sample for comparison |
| 59 | U | 158 | 96 | 0.499 | 5 | Sample of the invention |
| 60 | V | 140 | 87 | 0.395 | 4 | Sample of the invention |
| 61 | V | 120 | 93 | 0.697 | 5 | Sample of the invention |
| 62 | W | 120 | 62 | 0.021 | 3 | Sample of the invention |
| 63 | W | 142 | 98 | 0.659 | 5 | Sample of the invention |
| 64 | X | 125 | 93 | 0.656 | 5 | Sample of the invention |
| 65 | X | 114 | 42 | −0.264 | 0 | Sample for comparison |
| 66 | X | 140 | 96 | 0.620 | 5 | Sample of the invention |
| 67 | X | *95 | 46 | −0.020 | 0 | Sample for comparison |
| 68 | Y | 172 | 90 | 0.262 | 5 | Sample of the invention |
| 69 | Y | *143 | 62 | −0.154 | 0 | Sample for comparison |
| 70 | Y | *129 | 60 | −0.088 | 0 | Sample for comparison |
| 71 | Z | 163 | 85 | 0.196 | 4 | Sample of the invention |
| 72 | Z | 145 | 76 | 0.112 | 4 | Sample of the invention |
| 73 | Z | *104 | 40 | −0.203 | 0 | Sample for comparison |
| 74 | Z | *135 | 62 | −0.096 | 0 | Sample for comparison |
| 75 | a | 170 | 60 | −0.364 | 0 | Sample for comparison |
| 76 | b | 136 | 97 | 0.675 | 0 | Sample for comparison |
| 77 | c | 130 | 88 | 0.493 | 1 | Sample for comparison |
| 78 | d | 143 | 100 | 0.705 | 0 | Sample for comparison |
| 79 | e | 160 | 100 | 0.593 | 0 | Sample for comparison |
| 80 | e | 130 | 52 | −0.236 | 0 | Sample for comparison |
| 81 | f | 180 | 100 | 0.475 | 0 | Sample for comparison |
| 82 | g | 118 | 100 | 0.898 | 1 | Sample for comparison |
| 83 | h | 151 | 95 | 0.518 | 0 | Sample for comparison |
| 84 | i | 155 | 100 | 0.625 | 0 | Sample for comparison |
| 85 | j | 140 | 90 | 0.468 | 0 | Sample for comparison |

Mark "*" shows outside the scope of the present invention.

TABLE 4

| Sample No. | Kind of Steel | Ceq | Soaking temperature (°C.) | Lower limit temperature for quench. start (°C.) | Quench. start temperature (°C.) | Low temperature holding temperature (°C.) | Lower limit of tensile strength (kgf/mm$^2$) | Tensile strength (kgf/mm$^2$) | Residual strength ratio (%) | $P_{DF}$ | Delayed fracture resistance evaluation (points) | Remarks |
|---|---|---|---|---|---|---|---|---|---|---|---|---|
| 91 | B | 0.43 | 850 | 737 | 750 | 320 | 95 | 107 | 68 | 0.251 | 3 | Sample of the invention |
| 92 | D | 0.63 | 820 | 732 | 750 | 300 | 131 | 131 | 70 | 0.089 | 5 | Sample of the invention |
| 93 | D | 0.63 | 820 | 732 | *700 | 270 | 131 | *125 | 62 | −0.019 | 0 | Sample for comparison |
| 94 | J | 0.51 | 850 | 706 | 760 | 340 | 106 | 113 | 63 | 0.100 | 5 | Sample of the invention |
| 95 | N | 0.43 | 850 | 659 | 700 | 290 | 95 | 109 | 65 | 0.174 | 5 | Sample of the invention |
| 96 | O | 0.61 | 840 | 707 | 720 | 300 | 127 | *118 | 55 | −0.087 | 0 | Sample for comparison |
| 97 | O | 0.61 | 840 | 707 | *650 | 250 | 127 | *120 | 58 | −0.051 | 0 | Sample for comparison |
| 98 | R | 0.47 | 850 | 762 | 790 | 320 | 100 | 116 | 50 | −0.155 | 0 | Sample for comparison |

$Ceq = C + Si/24 + Mn/6$

Lower limot of tensile strength $= 32 \times (Ceq)^2 - 155 \times Ceq + 102$

Mark "*" shows outside the scope of the present invention.

The above-mentioned residual strength ratio ($R_r$) of each of the samples of the invention and the samples for comparison was determined in accordance with the method described with reference to FIG. 5.

The above-mentioned delayed fracture resistance of each of the samples of the invention and the samples for comparison was evaluated in accordance with the following evaluation method.

Figure 6:
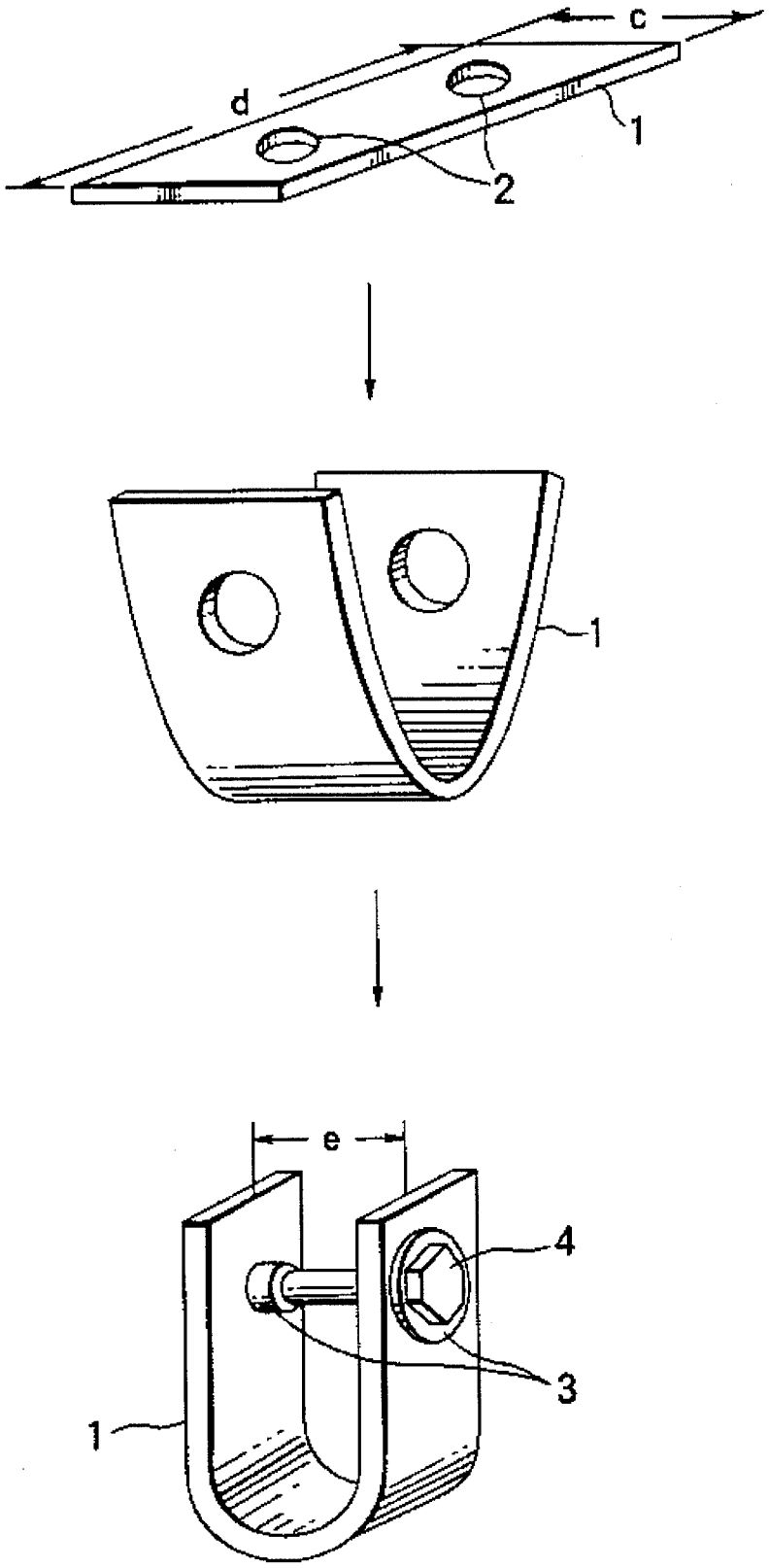
FIG. 6 is a schematic descriptive view illustrating the steps for preparing a test piece for evaluating delayed fracture resistance in an ultra-high-strength cold-rolled steel sheet.

More specifically, as shown in FIG. 6, a strip-shaped test piece 1 having dimensions of a thickness of 1.4 mm, a width (c) of 30 mm and a length (d) of 100 mm, and having grinding-treated edge faces, was cut out from each of the samples of-the invention and the samples for comparison. Then, a hole 2 was pierced in each of both end portions of the strip-shaped test piece 1. A center portion of the test piece 1 was then subjected to a bending with a radius of 5 mm. Then, a bolt 4 made of stainless steel was inserted into the above-mentioned two holes 2 through two washers 3 made of a tetrafluoroethylene resin, which washers inhibited formation of a local cell caused by the contact between different kinds of metal, to tighten the both end portions facing to each other of the test piece 1 by means of the bolt 4 until the distance (e) between the both ends of the test piece 1 became 10 mm, so as to apply stress to the bent portion of the test piece 1.

The strip-shaped test piece 1 of each of the samples of the invention and the samples for comparison thus applied with stress was immersed into 0.1 N hydrochloric acid to measure the time required before the occurrence of fractures in the bent portion of the test piece 1. Delayed fracture resistance of each of the samples of the invention and the samples for comparison was evaluated in the above-mentioned measurement by giving an evaluation of delayed fracture resistance of 0 point to the occurrence of fractures in the bent portion within 24 hours, 1 point to the occurrence of fractures within 100 hours, 2 points to the occurrence of fractures within 200 hours, 3 points to the occurrence of fractures within 300 hours, 4 points to the occurrence of fractures within 400 hours (400 hours not included), and 5 points to non-occurrence of fractures upon the lapse of 400 hours. Because the reduction in thickness of the test piece 1 and the production of local corrosion pits were serious after the lapse of 400 hours, the measurement was discontinued upon the lapse of 400 hours.

The above-mentioned test results of the residual strength ratio and the delayed fracture resistance are described further in detail with reference to FIGS. 1 to 4. FIG. 1 is a graph illustrating the relationship between an evaluation of delayed fracture resistance and a delayed fracture resistance index ($P_{DF}$) in an ultra-high-strength cold-rolled steel sheet (i.e., each of the samples of the invention and the samples for comparison). In FIG. 1, the mark "○" represents a sample comprising any one of steels "A" to "Z" having the chemical compositions within the scope of the present invention, which are free of niobium (Nb), titanium (Ti) and vanadium (V), and the mark "●" presents a sample comprising any one of steels "A" to "Z" having the chemical compositions within the scope of the present invention, which contain at least one of niobium, titanium and vanadium. The mark "○" and the mark "●" represent not only the sample of the invention but also the sample for comparison. The mark "▲" represents the sample for comparison comprising any one of steel "a" to "j" having the chemical compositions outside the scope of the present invention.

As is clear from FIG. 1, all of the samples of the invention having a $P_{DF}$ (delayed fracture resistance index) of at least 0 show an evaluation of delayed fracture resistance of at least 3 points, and therefore, represent an excellent delayed fracture resistance. All of the samples for comparison show in contrast an evaluation of delayed fracture resistance of up to 1 point even with a $P_{DF}$ of at least 0, and therefore, represent a poor delayed fracture resistance.

Figure 2:
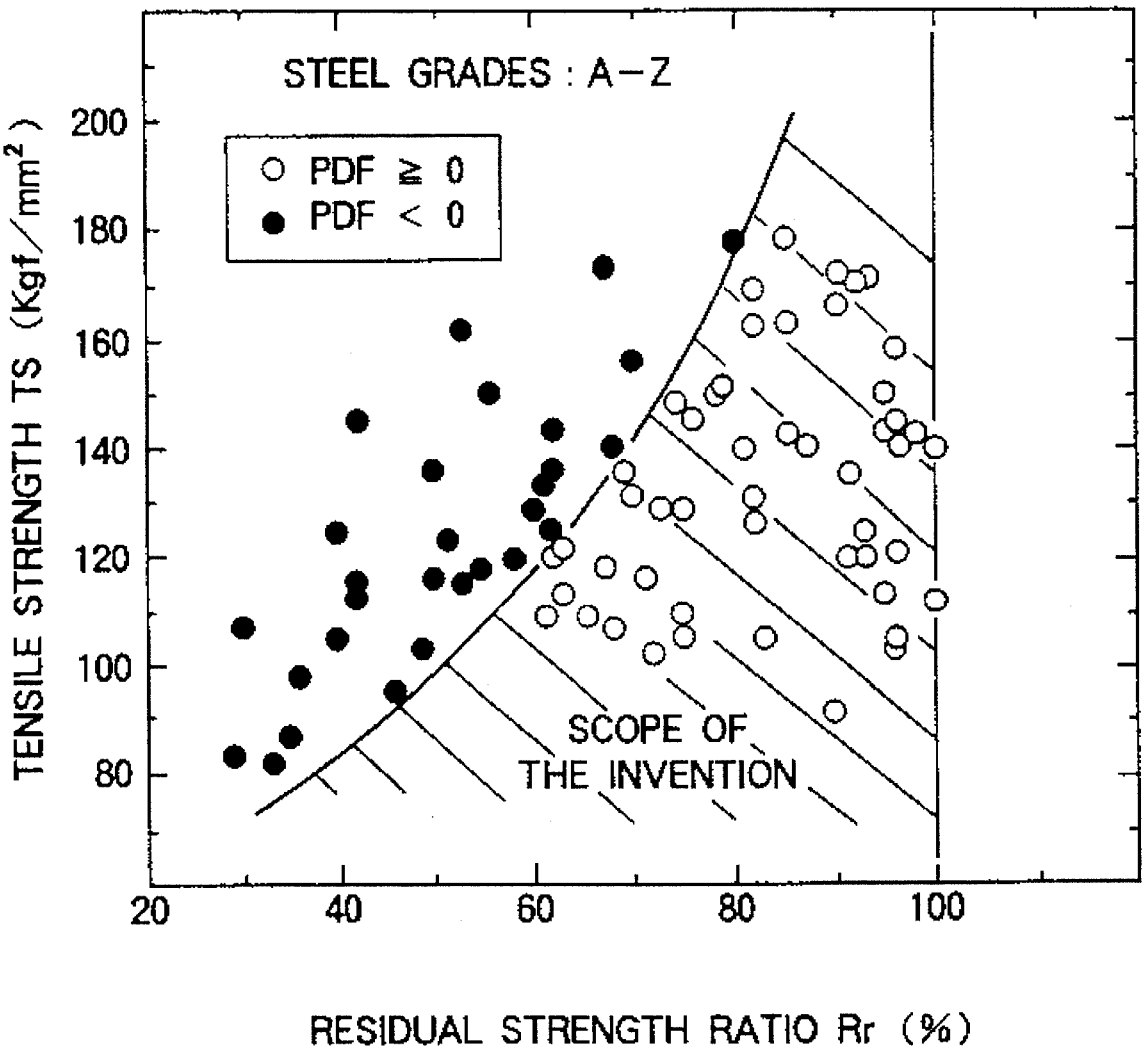
FIG. 2 is a graph illustrating the effect of a residual strength ratio (Rr) and tensile strength (TS) on a delayed fracture resistance index ($P_{DF}$) in an ultra-high-strength cold-rolled steel sheet.

FIG. 2 is a graph illustrating the effect of a residual strength ratio ($R_r$) and tensile strength (TS) on a delayed fracture resistance index ($P_{DF}$) in an ultra-high-strength cold-rolled steel sheet (i.e., each of the samples of the invention and the samples for comparison). In FIG. 2, the mark "○" represents the sample of the invention having a $P_{DF}$ of at least 0, and the mark "●" represents the sample for comparison having a $P_{DF}$ of under 0. As is clear from FIG. 2, all of the samples of the invention having a $P_{DF}$ of at least 0 show a residual strength ratio ($R_r$) more excellent than that of the samples for comparison relative to the same tensile strength (TS). More specifically, the samples of the invention having a $P_{DF}$ of at least 0 show a residual strength ratio of at least 60%, and the samples of the invention having a high tensile strength of at least 140 kgf/mm$^2$ show a high residual strength ratio of at least 70%. This suggests that the samples of the invention have a high tensile strength as well as an excellent delayed fracture resistance.

Figure 3:
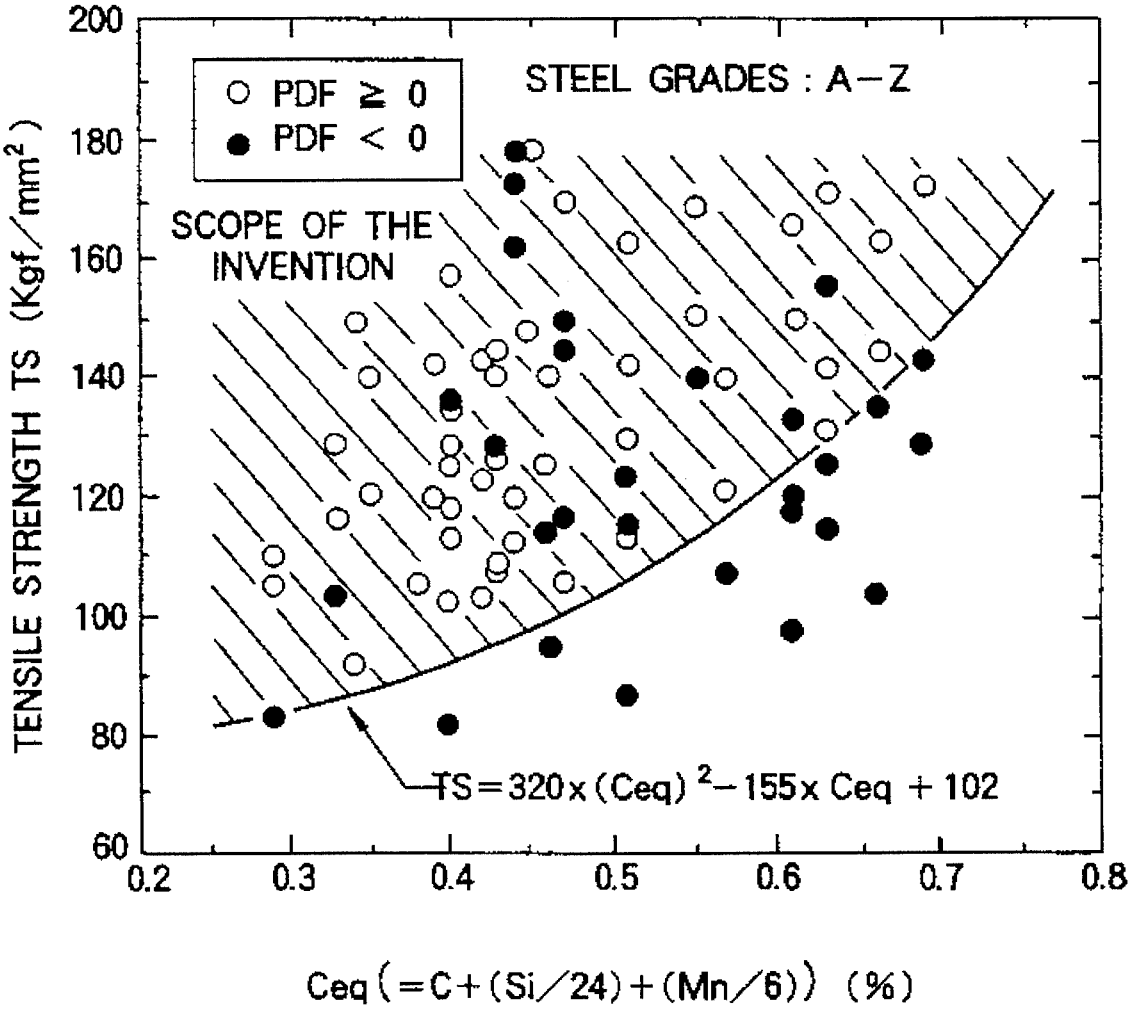
FIG. 3 is a graph illustrating the effect of Ceq (=C+(Si/24)+(Mn/6)) on the lower limit value of tensile strength (TS) in an ultra-high-strength cold-rolled steel sheet.

FIG. 3 is a graph illustrating the effect of Ceq (=C+(Si/24)+(Mn/6)) on the lower limit value of tensile strength (TS) in an ultra-high-strength cold-rolled steel sheet (i.e., each of the samples of the invention and the samples for comparison). In FIG. 3, the mark "○" represents the sample of the invention having a $P_{DF}$ (delayed fracture resistance index) of at least 0, the mark "●" represents the sample for comparison having a $P_{DF}$ of under 0, and the curve represents TS (tensile strength)=$320\times(Ceq)^2-155\times Ceq+102$. As is evident from FIG. 3, all of the samples of the invention have a high $P_{DF}$ of at least 0 and a high TS of at least $320\times(Ceq)^2-155\times Ceq+102$. Some samples for comparison, in contrast, while having a high TS of at least $320\times(Ceq)^2-155\times Ceq+102$, have a low $P_{DF}$ of under 0, and the remaining samples for comparison have a low TS of under $320\times(Ceq)^2-155\times Ceq+102$ and a low $P_{DF}$ of under 0.

More specifically, it is possible, in the samples of the invention, to inhibit formation of the banded structure in steel caused by the segregation of manganese under the effect of the coexistence of manganese with carbon and silicon, and it is also possible to prevent the structure of steel from becoming composite, by using a value of Ceq (=C+(Si/24)+(Mn/6)) as determined by the contents of carbon, silicon and manganese, and controlling the lower limit value of tensile strength (TS) of the cold-rolled steel sheet in response to the value of Ceq.

Figure 4:
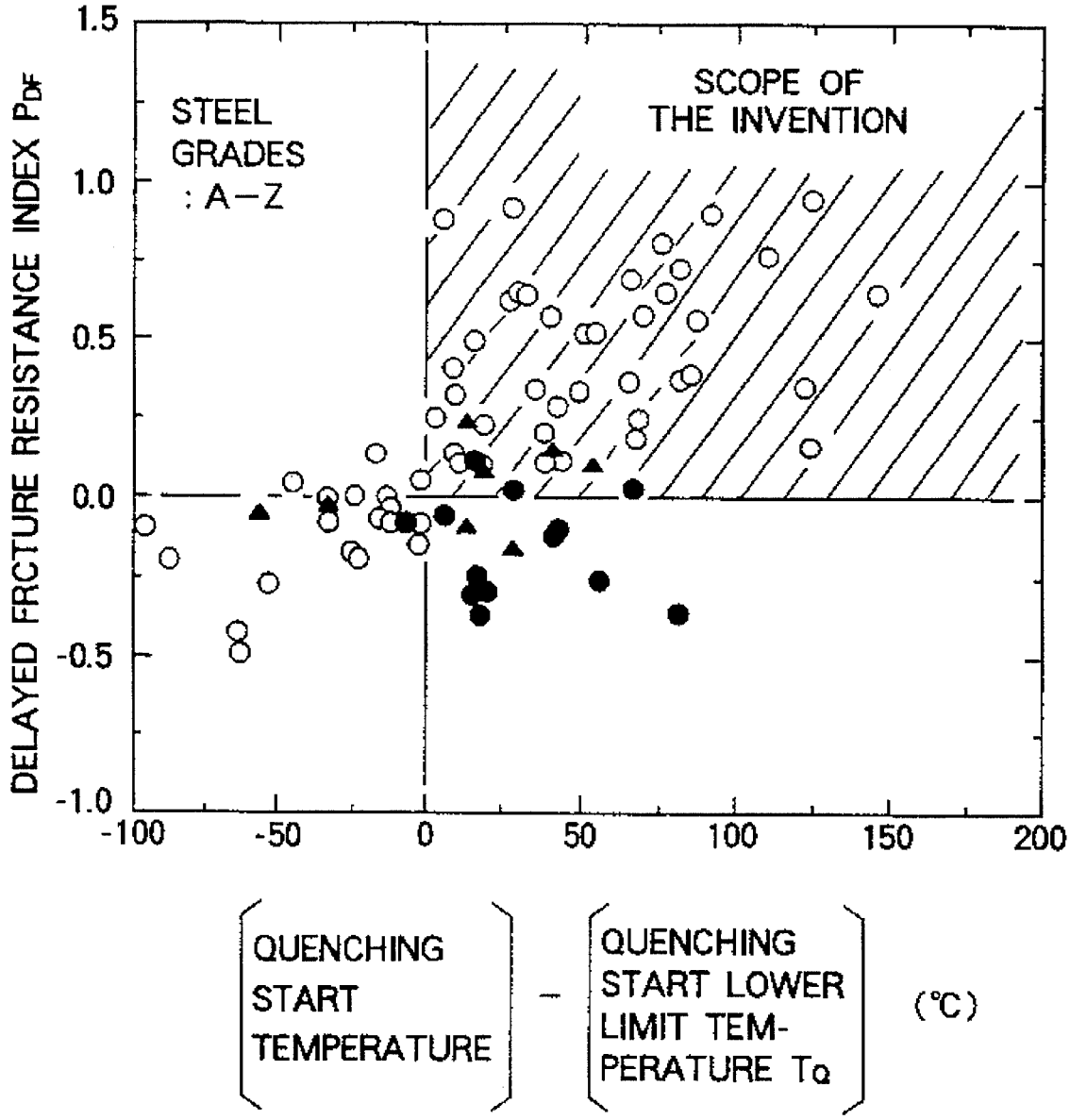
FIG. 4 is a graph illustrating the effect of manufacturing conditions on a delayed fracture resistance index ($P_{DF}$) in an ultra-high-strength cold-rolled steel sheet.

FIG. 4 is a graph illustrating the effect of manufacturing conditions on the delayed fracture resistance index ($P_{DF}$) in an ultra-high-strength cold-rolled steel sheet (i.e., each of the samples of the invention and the samples for comparison). In FIG. 4, the mark "○" represents the sample of the invention, the soaking temperature and the tempering temperature of which are within the scope of the present invention as shown in Table 2, the mark "●" represents the sample for comparison, the soaking temperature and/or the tempering temperature of which are outside the scope of the present invention also as shown in Table 2, and the mark "▲" represents the sample of the invention or the sample for comparison as shown in Table 4. As is clear from FIG. 4, in order that the $P_{DF}$ (delayed fracture resistance index) is at least 0, it is necessary to limit the quenching start temperature to at least the lower limit temperature ($T_Q$) for starting quenching, in addition to the control of the soaking temperature and the tempering temperature.

According to the present invention, as described above in detail, it is possible to provide an ultra-high-strength cold-rolled steel sheet excellent in delayed fracture resistance and having a high tensile strength of over 100 kgf/mm$^2$ and a method for manufacturing same, thus providing many industrially useful effects.

What is claimed is:

1. A method for manufacturing an ultra-high-strength cold-rolled steel sheet excellent in delayed fracture resistance, which comprises the steps of:

preparing a material consisting essentially of:

carbon (C): from 0.1 to 0.25 wt. %, silicon (Si): up to 1 wt. %, manganese (Mn) : from 1 to 2.5 wt. %, phosphorus (P): up to 0.020 wt. %, sulfur (S): up to 0.005 wt. %, soluble aluminum (Sol.Al): from 0.01 to 0.05 wt. %, nitrogen (N): from 0.0010 to 0.0050 wt. %, optionally at least one element selected from the group consisting of Nb Ti and V, in an effective amount for forming carbon nitrides to achieve a finer structure of steel;

optionally at least one element selected from the group consisting of Cu, Ni, B, Cr and Mo, in an effective amount for increasing the hardenability of steel; and the balance being iron (Fe) and incidental impurities; then subjecting said material to a high rolling, a pickling and a cold rolling to prepare a cold-rolled steel sheet; then subjecting said cold-rolled steel sheet thus prepared to a continuous heat treatment which comprises the steps of:

soaking said cold-rolled steel sheet at a temperature within a range of from $Ac_3$ to 900° C. for a period of time within a range of from 30 seconds to 15 minutes, then quenching the thus soaked cold-rolled steel sheet at a quenching rate of at least 400° C./second from a temperature of at least a lower limit temperature ($T_Q$) for starting quenching as expressed by the following formula to a temperature of up to 100° C.:

$$T_Q\,(°C.) = 600 + 800 \times C + (20 \times Si + 12 \times Mo + 13 \times Cr) - (30 \times Mn + 8 \times Cu + 7 \times Ni + 5000 \times B),$$

wherein C, Si, Mo, Cr, Mn, Cu, Ni and B are respectively weight percents for carbon, silicon, molybdenum, chromium, manganese, copper, nickel and boron, and then, tempering the thus soaked and quenched cold-rolled steel sheet at a temperature within a range of from 100° to 300° C. for a period of time within a range of from 1 to 15 minutes.

2. A method as claimed in claim 1, wherein:

said material further additionally contains at least one element selected from the group consisting of:

niobium (Nb): from 0.005 to 0.05 wt. %, titanium (Ti): from 0.005 to 0.05 wt. %, and vanadium (V): from 0.01 to 0.1 wt. %.

3. A method as claimed in claim 1, wherein:

said material further additionally contains at least one element selected from the group consisting of:

copper (Cu): from 0.1 to 1.0 wt. %, nickel (Ni): from 0.1 to 1.0 wt. %, boron (B): from 0.0005 to 0.0030 wt. %, chromium (Cr): from 0.1 to 1.0 wt. %, and molybdenum (Mo): from 0.1 to 0.5 wt. %.

4. A method as claimed in claim 2, wherein:

said material further additionally contains at least one element selected from the group consisting of:

copper (Cu): from 0.1 to 1.0 wt. %, nickel (Ni): from 0.1 to 1.0 wt. %, boron (B): from 0.0005 to 0.0030 wt. %, chromium (Cr): from 0.1 to 1.0 wt. %, and molybdenum (Mo): from 0.1 to 0.5 wt. %.

* * * * *

UNITED STATES PATENT AND TRADEMARK OFFICE

CERTIFICATE OF CORRECTION

PATENT NO. : 5,542,996

DATED : August 6, 1996

INVENTOR(S) : NAGATAKI et al

It is certified that error appears in the above-indentified patent and that said Letters Patent is hereby corrected as shown below:

Column 19, line 29, (Claim 1): replace "high" with --hot--.

Signed and Sealed this

Nineteenth Day of August, 1997

*Attest:*

*Attesting Officer*

BRUCE LEHMAN

*Commissioner of Patents and Trademarks*